United States Patent [19]

Gherardi

[11] Patent Number: 4,974,608

[45] Date of Patent: Dec. 4, 1990

[54] MACHINE FOR MANUFACTURING FILTER-TIP CIGARETTES

[75] Inventor: Gian L. Gherardi, Medicina, Italy

[73] Assignee: SASIB S.p.A., Italy

[21] Appl. No.: 375,600

[22] Filed: Jul. 5, 1989

[30] Foreign Application Priority Data

Jul. 15, 1988 [IT] Italy ..... 12523 A/88

[51] Int. Cl.[5] ..... A24C 5/18

[52] U.S. Cl. ..... 131/94; 131/84.1; 131/95; 131/282

[58] Field of Search ..... 131/94, 95, 282, 36, 131/57.1, 84.1

[56] References Cited

U.S. PATENT DOCUMENTS

| | | | |
|---|---|---|---|
| 3,099,989 | 8/1963 | Rudszinat et al. | 131/94 |
| 3,665,930 | 5/1972 | Giatti | 131/94 |
| 4,044,779 | 8/1977 | Preston et al. | 131/94 |
| 4,480,266 | 6/1989 | Gherardi | 131/94 |

*Primary Examiner*—V. Millin

*Assistant Examiner*—Jennifer L. Doyle

*Attorney, Agent, or Firm*—Larson & Taylor

[57] ABSTRACT

This invention relates to the machines for manufacturing filter-tip cigarettes by forming successive groups (S+2F+S) each formed by two aligned cigarettes (S) and one interposed double filter (2F), and by wrapping and glueing a covering strip (T) around the double filter (2F) and adjacent ends of the two cigarettes (S). The formation of the groups (S+2F+S) is carried out on a composition drum (1) whereon the double filters (2F) and the pairs of cigarettes (S) are held by suction. The application of the strip (T) may be carried out either on said composition drum (1) or on a successive assembling drum (6), and the strips are fed by a strip-carrying drum (7) whereon they are held by suction. In the absence of a component, e.g. a double filter (2F), in a group (S+2F+S), all the other components of the same group, i.e. the two cigarettes (S) and covering strip (T), are discarded automatically by affecting for this purpose only the suction exerted on the components to be discarded.

8 Claims, 4 Drawing Sheets

MACHINE FOR MANUFACTURING FILTER-TIP CIGARETTES

SUMMARY OF THE INVENTION

This invention relates to the machines for manufacturing filter-tip cigarettes, wherein successive groups each comprising two aligned cigarettes with an interposed double-length filter are formed on a rotatable composition drum, each of said two cigarettes and filter being held on the composition drum by suction exerted through slits or drawholes provided peripherally in said drum and connectible, through ducts formed in said drum, and over a pre-established angle of rotation thereof, to a vacuum source, while on said composition drum or on a successive rotatable assembling drum, to which the groups comprising the two cigarettes and interposed double filter are transferred, around said filter and adjacent ends of the two cigarettes of each group, there will be wrapped and glued a fastening band, so-called covering strip, which is fed by means of a rotating strip-carrying drum whereon the successive covering strips are each held by suction exerted through one or more corresponding peripheral holes in said strip-carrying drum.

In the machines of this type, when a double-length filter is not deposited for any reason between two aligned cigarettes on the composition drum, the covering strip fed subsequently to these two cigarettes will be wrapped and glued with difficulty around their facing ends, so that it may become detached and foul with glue the operating members of the machine, with resulting jamming, stopping and even damaging.

The invention aims to overcome these disadvantages by automatically causing—in case of absence of the double-length filter between two aligned cigarettes of a group on the assembling drum—all the components of the respective incomplete group to be discarded, i.e. by causing the two cigarettes to be removed from the assembling drum and by avoiding the transfer of the corresponding covering strip from the strip-carrying drum to either the assembling drum or the connection drum, all the above with no need of sensors and no purposely-provided displacement or removal devices of the two cigarettes of the incomplete group.

According to the invention, in order to discard the two cigarettes of a group in case of absence of the interposed double filter, the drawmouths associated with the two cigarettes of each group and/or at least a portion of the ducts connecting these drawmouths to the vacuum source, are in communication with the drawmouth associated with the corresponding interposed double filter, so that, when the double filter is present between the two cigarettes of a group and thus closes the respective drawmouth, the suction exerted through the drawmouth associated with the two cigarettes of the group is sufficient to hold these cigarettes on the composition drum, whereas when said filter is absent and, therefore, the respective drawmouth is open, the communication of this drawmouth with the drawmouths associated with the two cigarettes of the group or with at least a section of the respective ducts connected to the vacuum source, causes such a reduction of the suction through the drawmouths associated with the cigarettes, whereby said cigarettes cannot be held further on the composition drum.

To prevent a covering strip from being applied to the composition drum or to the assembling drum onto a void space, i.e. a space lacking a group comprising two aligned cigarettes and an interposed double filter, according to the invention each strip on the strip-carrying drum is provided with glue on the outer side thereof and is detached and picked up from the strip-carrying drum by the engagement and adhesion between the front end (referred to the direction of rotation of the strip-carrying drum) of a strip and the associated group existing on the composition drum or assembling drum, while in the region where said strip is detached and picked up the invention provides means to cause such a partial reduction of the suction exerted through the drawhole (S) associated with said front end of the strip, whereby the force of the residual suction is less than said adhesion force of the strip to a group comprising two cigarettes and one interposed double filter, thus permitting said strip to be detached from the strip-carrying drum and picked up by engagement and adhesion by said group when the latter is present on the composition drum or on the assembling drum, whereas when said group is absent the associated strip is retained by said residual suction with its front end on the strip-carrying drum and moves further thereon past the pick-up region, to be then removed. These and other characteristics of the invention and the advantages resulting therefrom will be apparent with more details in the following description of an embodiment thereof, shown by way of non-limiting example in the accompanying drawings, wherein:

DESCRIPTION OF THE PREFERRED EMBODIMENTS

Figure 1:
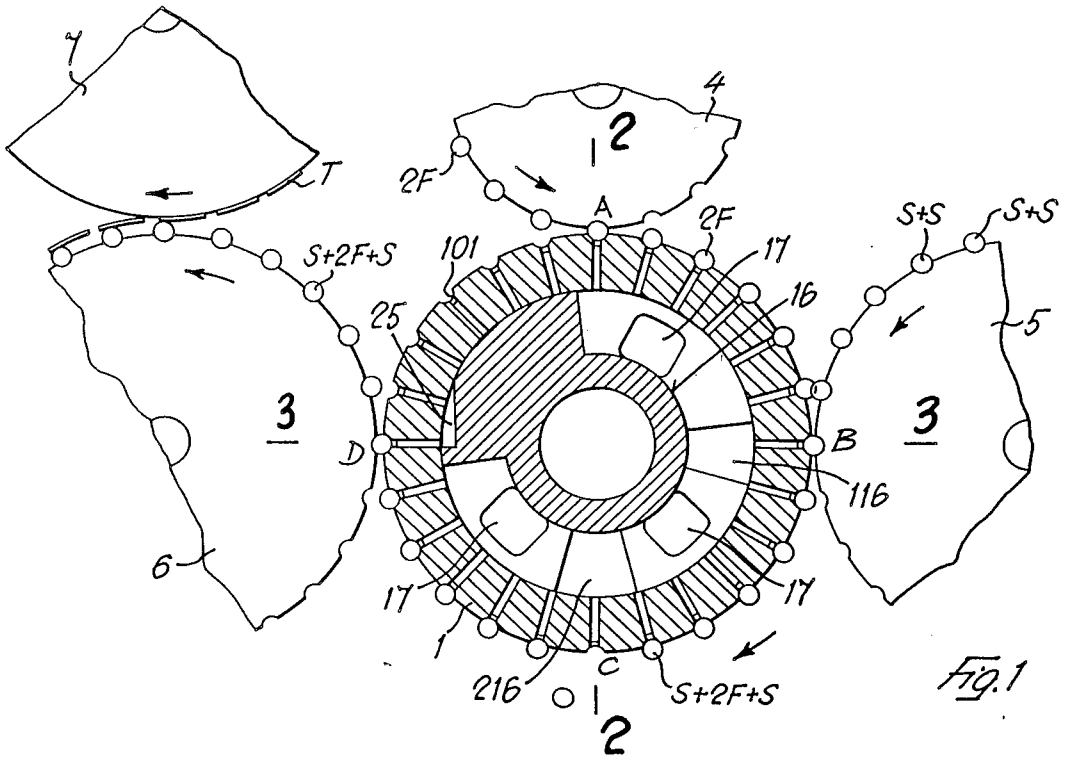
FIG. 1 shows quite diagrammatically, an elevational and partly sectional view of a portion of a machine for manufacturing filter-tip cigarettes.

FIG. 1 shows a fragmentary diagram of a machine for manufacturing filter-tip cigarettes. The numeral 1 indicates a recessed drum, so-called composition drum. A group made up of two aligned cigarettes S and one double-length filter 2F interposed between said two cigarettes S is formed in each peripheral recess of said drum 1. The two cigarettes S of each group S+2F+S are held on the composition drum 1 by suction exerted through corresponding slits or drawmouths 2 provided in the bottom of the recesses 101 and each extending over a certain intermediate portion of the length of the respective cigarette S. Similarly, the double filter 2F of each group is also held on the composition drum 1 by means of a corresponding slit or drawmouth 3 provided in the bottom of the recesses 101 and extending over a certain intermediate portion of the length of said double filter 2F.

The double-length filters 2F are transferred after each other from the feeding drum 4 to the composition drum 1 at the zone A, while the two cigarettes S are laid down onto the composition drum 1 at both sides of the filters F by the feeding drum 5 at the zone B, which follows the zone A in the direction of rotation of the composition drum 1 and spaced angularly with respect thereto, e.g. through 90°. At a successive zone D, which is spaced, for example, through 180° with respect to the cigarette-feeding zone B, the individual groups S+2F+S each comprising the two cigarettes S and one interposed double filter 2F, are transferred to a further drum 6, so-called assembling drum, whereon a fastening band T, so-called covering strip, previously coated with glue, is wrapped around the double filter 2F of each group S+2F+S and around the adjacent ends of the two cigarettes S. By means of said covering strip T, the two cigarettes S of each group S+2F+S are connected to the interposed double filter 2F. Thereafter, each group S+2F+S is severed into two filter-tip cigarettes by cutting through intermediately the double filter 2F.

As to the construction, the composition drum 1 comprises a hollow cylinder which is rotatably and sealingly mounted on a cylindrical vacuum-distributor 8 overhangingly secured by means of bolts 9 to a supporting wall 10. Opposite the free end of the distributor 8, the composition drum 1 is provided with an end wall 11 by means of which it is secured to a co-axial shaft 12 which is supported by means of bearings 13, 14 in an axial through-bore 108 in the vacuum-distributor 8 and is rotated by means of a toothed wheel 15.

At the composition drum 1, the vacuum-distributor 8 is formed with a peripheral suction groove which is generally indicated at 16 and extends circumferentially from a spot just upstream of the zone A where the double filters 2F are transferred from the feeding drum 4 to the composition drum 1, to a spot just upstream of the zone D where the groups S+2F+S are transferred from the composition drum 1 to the assembling drum 6. Said peripheral suction groove 16 in the vacuum-distributor 8 communicates with a vacuum source (not shown) by means of one or more longitudinal ducts 17, angularly spaced from each other (see FIG. 1) and an annular chamber 18, which are formed within the body of the distributor 8, and by means of a tubing 19.

The drawmouths 2 provided in each recess 101 of the composition drum 1 in registry with the cigarettes S, are each in communication with two radial holes 22, 21 which are spaced apart in the longitudinal direction of the respective recess 101 and open into the interior cylindrical surface of the composition drum 1. The inner radial suction holes 21, which are associated with each of the two drawmouths 2 of a recess 101 of the composition drum 1 are in communication each through a slanting duct 24 with the intermediate drawmouth 3 of the respective recess 101, associated with the double filter 2F which is interposed between the two cigarettes S.

The two slanting ducts 24 open into corresponding depressions 124 of the drawmouth 3. The drawmouth 3 associated with the double filter 2F, moreover, communicates with a radial intermediate suction hole 23 which opens into the interior cylindrical surface of the composition drum 1. The cross sectional area of this radial intermediate suction hole (23) is comparatively large with respect to that of the slanting ducts 24.

Figure 4:
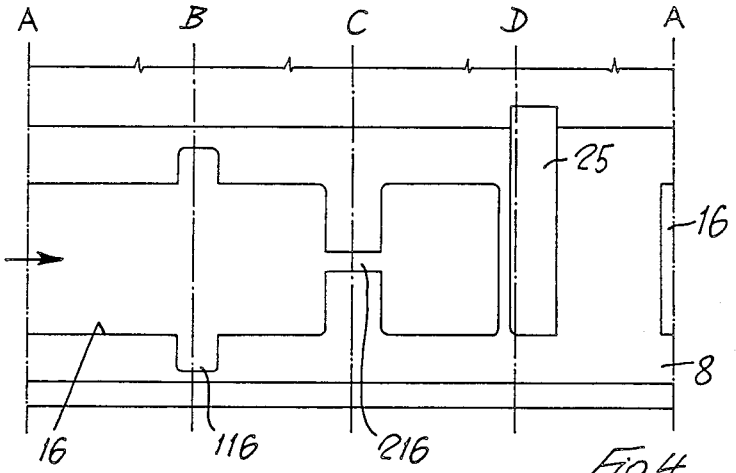
FIG. 4 diagrammatically shows the layout of the peripheral suction groove in the vacuum distributor associated with the composition drum according to FIGS. 1 to 3.

The width of the peripheral suction groove 16 of the vacuum-distributor 8 changes, for example, steppingly along the circumference of said distributor, as viewed clearly in the layout shown in FIG. 4. More particularly, at the zone A, where the double filters 2F are transferred from the feeding drum 4 to the composition drum 1, the suction groove 16 has such a width as to permit the communication therewith—therefore, with the vacuum source—of only the radial hole 23 associated with the drawmouth 3 for the double filter 2F, and the inner holes 21 of the two pairs of radial suction holes 21, 22 associated with the drawmouths 2 for the cigarettes S, as viewed in the upper portion of FIG. 2. As a result, a greater flowrate of sucked air occurs through the drawmouth 3 associated with the double filter 2F, due to the comparatively small section of the slanting holes 24 communicating, at one side, with said drawmouth 3 and, at the other side, with the atmosphere through the inner holes 21 of the still uncovered drawmouths 2 associated with the two cigarettes S. As a result, the double filters 2F picked up from the feeding drum 4 will be held firmly on the composition drum 1.

In the zone B where the cigarettes S are transferred from the feeding drum 5 to the composition drum 1, the peripheral suction groove 16 of the vacuum-distributor 8 has such a widening 116 whereby also the outer radial suction holes 22 of the two drawmouths 2 associated with the cigarettes S will communicate with said groove 16, 116 and, therefore, with the vacuum source. Therefore, the cigarettes S transferred from the feeding drum 5 to the composition drum 1 will be firmly held by suction on said composition drum 1, even if the double filter 2F should be absent, that is even if the associated intermediate drawmouth 3 of the resepective recess 101 should be left uncovered and, therefore, in communication with the atmosphere.

Figure 2:
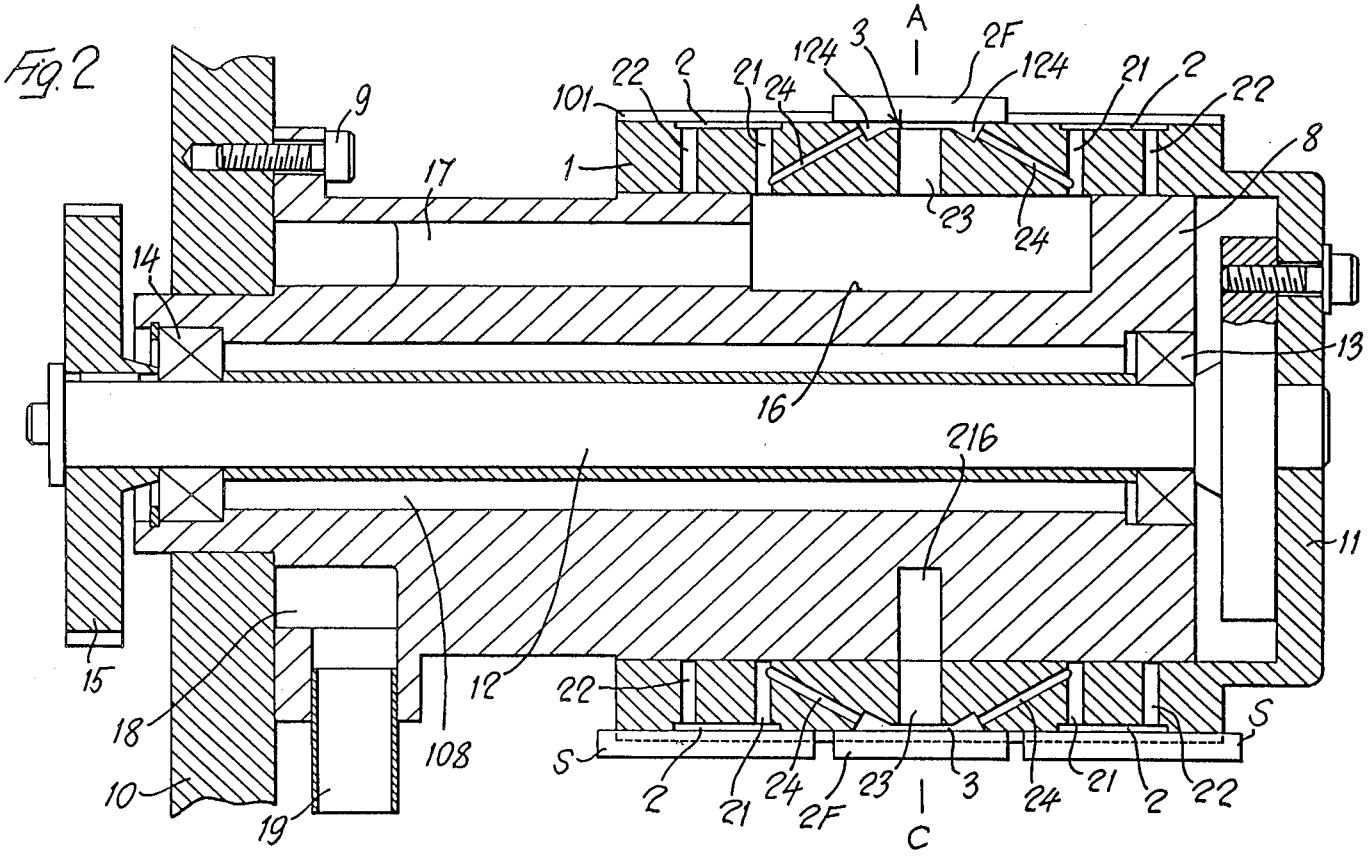
FIG. 2 is a longitudinal sectional view of the drum for the composition of the groups each made up by two aligned cigarettes and one interposed double-length filter, on the line 2—2 of FIG. 1.
Figure 3:
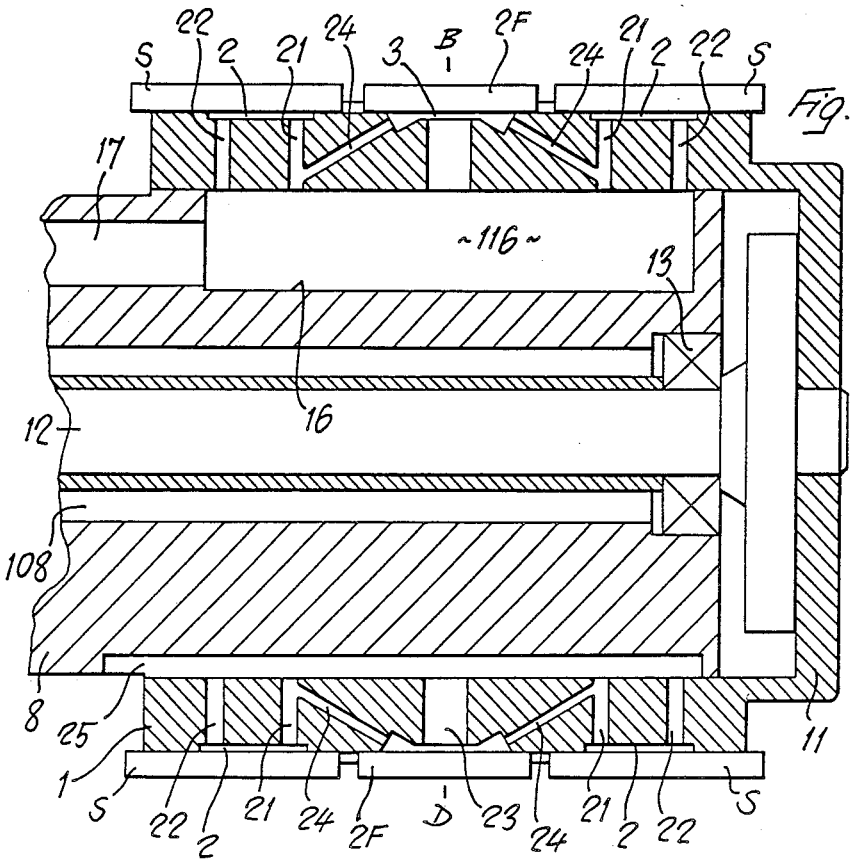
FIG. 3 is a fragmentary longitudinal sectional view of said composition drum, on the line3—3 of FIG. 1.

At an intermediate zone C, situated between the two zones B and D on the lower side of the composition drum 1, the peripheral suction groove 16 of the vacuum-distributor 8 comprises a portion 216 which extends over a small arc and is abruptly and considerably narrowed so that only the radial suction hole 23 of the intermediate drawmouth 3 associated with the double filter 2F is left in communication with this narrow portion 216 of said suction groove 16, while all the radial suction holes 21, 22 of the two lateral drawmouths 2 associated with the cigarettes S will be closed, as shown in the lower portion of FIG. 2. In these conditions, when a double filter 2F is present in a recess 101 of the composition drum 1 and covers the respective drawmouth 3, the suction exerted in this drawmouth 3 through the respective radial suction hole 23 will be exerted, through the slanting connecting holes 24, at least partially also in the two lateral drawmouths 2 associated with the two cigarettes S, with a force which is sufficient to hold these cigarettes S in the respective recess 101 of the composition drum 1 over the small angle of rotation of said drum that corresponds to the narrow portion 216 of the suction groove 16. Past the end of said narrow portion 216 of the peripheral suction groove 16 of the vacuum-distributor 8, said groove has a further widening so as to communicate also with at least the inner radial suction holes 21 of the two lateral drawmouths 2 associated with the cigarettes S, whereby the suction is also exerted directly in these lateral drawmouths 2 and the cigarettes S will be firmly held on the composition drum 1.

However, when at the zone C the double filter 2F between the two cigarettes S is absent in a recess 101 of the composition drum 1, the intermediate drawmouth 3 is left uncovered, i.e. in communication with the atmosphere, and the suction exerted through the respective radial hole 23 cannot propagate through the slanting connection holes 24 further to the lateral drawmouths 2, or it will be exerted in these lateral drawmouths 2 only with such a reduced force whereby the cigarettes cannot be held on the composition drum 1 against the action of their weight and centrifugal force and, therefore, they fall from said drum into suitable collecting means (not shown). The recess 101 of said drum 1, where the double filter 2F is absent, therefore, is left completely empty downstream of the zone C.

The peripheral groove 16 provided in the vacuum-distributor 8 and communicating with the vacuum source terminates at a short distance from the zone D whereat the groups S+2F+S are transferred from the composition drum 1 to the assembling drum 6. Over a small arc at said transfer zone D, the distributor 8 is formed with a peripheral recess 25, so-called vacuum-breaker recess, extending over the entire width of the composition drum 1 and communicating with the atmosphere. By means of this peripheral recess, all the radial suction holes 21, 22, 23 of the drawmouths 2, 3 of each recess 101 in the composition drum 1 are communicated with the atmosphere and thus release the groups S+2F+S each made up by two cigarettes S with an interposed double filter 2F.

Figure 5:
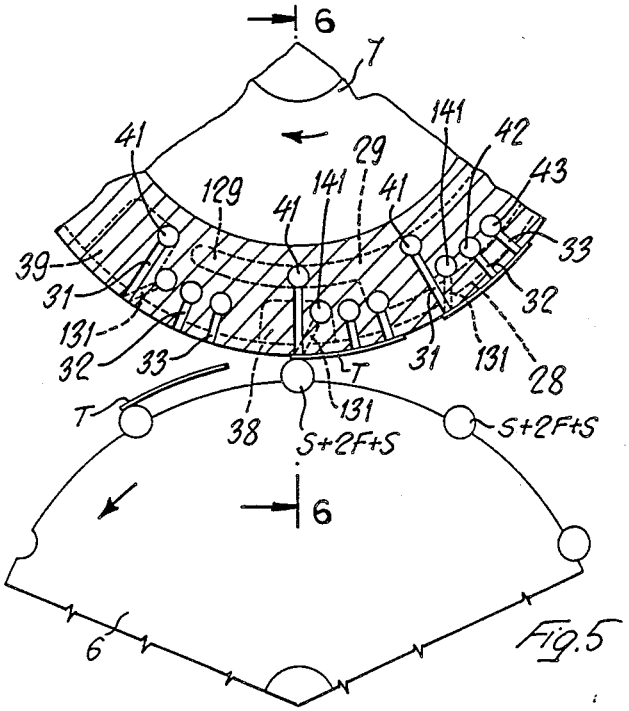
FIG. 5 diagrammatically shows an elevational and partly sectional view of a portion of the strip-carrying drum and associated assembling drum.
Figure 6:
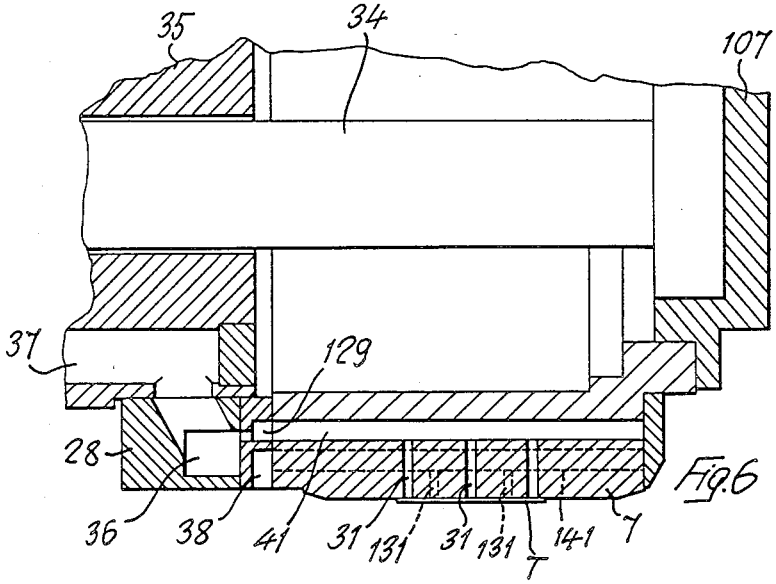
FIG. 6 is a fragmentary longitudinal sectional view of the strip-carrying drum according to the line 6—6 of FIG. 5.

With reference to FIGS. 5 and 6, the covering strips T are fed to the assembling drum 6 by means of a strip-carrying drum 7 which carries a series of angularly equally-spaced strips T provided with glue on the outer face thereof. Each strip T is held on the strip-carrying drum 7 by means of three successive rows of radial suction holes 31, 131; 32 and 33.

Each row of suction holes 31, 131; 32 and 33 extends along the axial direction of the drum 7 and comprises a plurality of radial suction holes distributed along the width of the strip T and designed to communicate with a vacuum source through a vacuum-distributor, associated with the strip-carrying drum 7.

As to its construction, and as shown in FIGS. 5 and 6, the strip-carrying drum 7, is formed of a hollow cylinder which is secured by means of its end wall 107 to the end of a shaft 34 which is rotatably supported in the stationary frame 35 and overhangingly protrudes therefrom.

The head surface of the strip-carrying drum 7, directed towards the frame 35, sealingly engages against a vacuum-distributing ring or sector 28 which is secured to the frame 35.

Formed in the surface of said ring 28 is an arcuate suction groove 29 communicating with a vacuum source (not shown) through conduits 36, 37 formed in the vacuum-distributing ring 28 and frame 35. Just before the most approached position of the strip-carrying drum 7 and assembling drum 6, the radial width of the arcuate groove 29 is reduced by a step towards the center of the drum 7, so that the arcuate suction groove 29 has a narrower arcuate extension 129 which is radially offset inwards. At the most approached position of the two drums 6 and 7, in the surface of the vacuum-distributing ring 28 there is provided—radially outwards of the narrower extension 129 of the arcuate suction groove 29—a so-called vacuum-breaker recess 28 communicating with the atmosphere and extending circumferentially over a small arc.

A further vacuum-breaker recess 39 of this type is provided in the vacuum-distributing ring 28 downstream of the end of the narrower extensin 129 of the arcuate suction groove 29, with respect to the direction of rotation of the strip-carrying drum 7.

The first row of suction holes 31, 131 associated with each strip T is designed to hold on the strip-carrying drum 7 the front end of the respective strip 7 (with respect to the direction of rotation of said drum). This row of suction holes comprises a certain member of radial deeper holes 31 and, therebetween, slanting less deep holes 131. The radial suction deeper holes 31 open into a manifold duct 41 extending paralle to the axis strip-carrying drum 7 and opening into the head surface thereof, facing towards the vacuum-distributing ring 28, at a radial position corresponding to the arcuate narrow extension 129 of the suction groove 29 of said ring 28. The slanting less deep suction holes 131 open into a manifold duct 141 also extending parallel to the axis of the strip-carrying drum 7 but opening into the head surface thereof, facing towards the vacuum-distributing ring 28, at a radial position corresponding to the radially outer portion of the suction arcuate groove 29, i.e. radially outwards of the narrow extension 129 of said groove 29, and in registry with the vacuum-breaking recess 38.

The radial suction holes 32, 33 of the other two rows of holes, which are associated with each strip T on the strip-carrying drum 7, open into corresponding manifold ducts 42 and 43 extending parallel to the axis of said drum 7 and opening into the head surface fo the strip-carrying drum 7, facing towards the vacuum-distributing ring 28, at radial positions substantially corresponding to that of said manifold duct 141.

Before reaching the zonde where it is applied to a group S+2F+S, on the assembling drum 6 each strip T is held firmly on the peripheral surface of the strip-carrying drum 7 by the action of the suction exerted through all the suction holes 31, 131, 32 and 33 because all the respective manifold ducts 41, 141, 42 and 43 communicate with the suction groove 29 in the vacuum-distributing ring 28 and, therefore, with the vacuum source (see right-hand portion of FIG. 5). When the front end of a covering strip T is at the spot where the two drums 6 and 7 are most proximate to each other, it engages a group S+2F+S present on the assembling drum 6 and comprising two cigarettes S and one interposed double filter 2F, and becomes glued to this group, as illustrated in the central portion of FIG. 5. At the same time, the manifold duct 141 for the slanting suciton holes 131 associated with the front end of the strip T, is communicated to the atmosphere through the vacuum-breaking recess 38 of the vacuum-distributing ring 28, whereby any suction will no longer be exerted through the slanting holes 131.

The front end of the strip T, therefore, is held on the strip-carrying drum 7 only by the action of the suction exerted through the suction holes 31 that still communicate with the vacuum source throught the manifold duct 41 and associated extension 129 of the arcuate suction groove 29, as shown in FIG. 6. The residual suction exerted through these holes 31, however, is smaller than the adhesion force of the front end of the strip T to the group S+2F+S on the assembling drum 6. Therefore, the front end of the strip T is detached from the strip-carrying drum 7 and dragged away by the group S+2F+S on the asssembling drum 6, against the action of the reduced suction exerted only through the holes 31.

Due to the rotation of the strip-carrying drum 7, also the manifold ducts 42, 43 of the successive rows of suction holes 32, 33 will pass over the vacuum-breaking recess 38 in the vacuum-distributing ring 28, whereby the suction through said holes 32, 33 will also be eliminated and the strip T is progressively released and, finally, detached completely from the strip-carrying drum 7, and its front end remains glued to the group S+2F+S on the assembling drum, as shown in the left-hand portion of FIG. 5.

Whenever the front end of a covering strip T being fed by the strip-carrying drum 7 does not meet a group S+2F+S on the assembling drum 6, for example, because the two cigarettes S of said group have been discarded previously, as described above, at the composition drum 1 due to the absence of the respective double filter 2F, no detachment and pick-up force will be exerted on said front end of the strip T and said end will be retained further on the strip-carrying drum 7 by the action of the residual suction exerted through the holes 31, the manifold duct 41 of which continues communicating with the narrow extension 129 of the arcuate suction groove 29. As a result, the strip T will be moved by the strip-carrying drum 7 past the spot most approached to the assembling drum 6 and is retained on the strip-carrying drum 7 by the action of the suction exerted through the holes 31 even when the suction through the holes 32, 33 ceases. Past the end of the narrow extension 129 of the arcuate suction groove 29, the manifold duct 41 starts communicating with the vacuum-breaking recess 39, whereby the suction holes 31 are communicated with the atmosphere and release also the front end of the strip T which, therefore, becomes detached automatically from the strip-carrying drum 7 by the action of either gravity or centrifugal force, and falls into suitable collecting means (not shown).

The advantages achieved by the invention will be apparent from the above. These advantages, mainly, consist of the fact that in case of absence of a double filter 2F intended for the formation of a group of two cigarettes S with one interposed double filter 2F, both the respective cigarettes S and covering strip T for said group S+2F+S will be discarded, so as to avoid completely any risk of contaminating the machine with cigarettes having no interposed double filter, which could possibly avoid being discarded due to defective glueing of the respective covering strip T or the presence of any lump of glue. A further advantage of the invention consists of the fact that said operative reliability is achieved in a completely automatic manner without using any sensors or movable members other that those which are utilized usually in this type of machines for the manufacture of filter-tip cigarettes, therefore with considerable constructional simplicity.

Of course, the invention is not limited to the embodiment just described and shown, but broad changes and modifications, especially of constructional nature, may be made thereto. Moreover, the device according to the invention for eliminating the two cigarettes S of a group S+2F+S in case of absence of the respective interposed double filter 2F, may also be used independently and in combination with any other device for avoiding the application of the respective covering strip T.

Similarly, the device according to the invention for avoiding the application of a covering strip in case of absence of the respective group comprising two cigarettes S and interposed double filter 2F, may also be used independently and in combination with any other device for eliminating two cigarettes S of a group S+2F+S when the respective double filter 2F is absent.

The principle of the invention for eliminating the two cigarettes S of a group S+2F+S when the respective double filter 2F is absent may also used for eliminating the double 2F in case of absence of the respective two cigarettes S. The invention may also be used advantageously in any other technological field involving similar problems, for example, in the manufacture of composite filter rods, i.e. made up of filter segments of different types wrapped entirely in a long fastening and covering band, for discarding automatically all the components of a filter rod in case of absence of one of them.

I claim:

1. A machine for manufacturing filter-tip cigarettes, wherein successive groups which each comprise two aligned cigarettes having one double-length filter therebetween are formed on a rotating composition drum, comprising:

means for holding each of the two cigarettes and its respective double-length filter on the composition drum by suction exerted through corresponding drawmouths provided on the periphery of the composition drum, said drawmouths being connectable to a vacuum source by means of a vacuum-distributor and conduits provided in the drum, an assembling drum located adjacent the composition drum for receiving successive groups of two aligned cigarettes having a double-length filter therebetween from the composition drum, means for transferring a fastening band to the double-length filters while on the assembling drum for adherence to the double-length filter and the adjacent ends of the two aligned cigarettes, a rotating band carrying drum for feeding the fastening bands to the successive groups on the assembly drum including means for holding successive fastening bands by suction on the band carrying drum through corresponding holes provided peripherally thereon and connectable to a vacuum source by means of a vacuum distributor, wherein discarding means are provided for automatically discarding from the composition drum any group of two cigarettes in the absence of a double-length filter therebetween, said discarding means including an arrangement wherein the drawmouths associated with the two aligned cigarettes of each group and at least a portion of the conduits associated with the drawmouths of the double-length filter interposed between those two aligned cigarettes are arranged such that when the double-length filter is present between the two aligned cigarettes of a group and therefore closes the respective drawmouths, the suction exerted through the drawmouths associated with the two aligned ciagrettes of this group is sufficient to hold these cigarettes on the composition drum, whereas when a double-length filter is not interposed between the two aligned cigarettes, the respective drawmouths between the two aligned cigarettes are open, whereupon the suction through the drawmouths associated with the two aligned cigarettes is reduced to such an extent as to be unable to hold the two aligned cigarettes on the composition drum.

2. A machine according to claim 1, wherein the vacuum distributor associated with the composition drum comprises a stationary cylindrical distributor body and the composition drum comprises a hollow cylinder sealingly rotatable on the distributor body, said distributor body being provided peripherally with a suction groove which communicates with a vacuum source and extends circumferentially from a zone "A" at which the double-length filters are fed to the composition drum through a zone "B" at which pairs of aligned cigarettes are fed to the composition drum, the zone "B" being located on both siades of the composition drum, taken in the axial direction thereof, so as to communicate with both cigarettes of the group, said vacuum distributor further extending to a zone "D" at which the successive groups comprising the two aligned cigarettes and the double-lenth filter therebetween are removed from the composition drum, the drawmouths associated with the two aligned cigarettes and the douible-length filter communicating with radial suction holes which are provided in the hollow composition drum, wherein the drawmouth associated with the double-length filter communicates with at least one radial suction hole, said at leasst one radial suction hole being in communication only with the drawmouth associated with the double-length filter, and the drawmouths associated with each cigarette communicate with at least two additional radial suction holes which are spaced apart along the respective drawmouths and one of said two additional radial suction holes is also connected to the drawmouths which are associated with the double-length filter.

3. A machine according to claim 1, wherein the peripheral suction groove in the distributor body has, at zone "A" such a width as to communicate only with the radial suction holes which communicate with the drawmouth associated with said double-length filter, while the suction groove has, at zone "B" such an arrangement as to communicate with all the radial suction holes.

4. A machine according to claim 1, wherein downstream of the zone "B", taken in the direciton of travel of the composition drum, the peripheral suction groove of the distributor body has such a restriction as to communicate only with the at least one suction hole connected only to the drawmouth associated with the double-length filter.

5. A machine for manufacturing filter-tip cigarettes, wherein successive groups which each comprise two aligned cigarettes having one double-length filter therebetween are formed on a rotating composition drum, comprising:

means for holding each of the two cigarettes and its respective double-length filter on the composition drum by suction exerted through corresponding drawmouths provided on the periphery of the composition drum, said drawmouths being connectable to a vacuum source by means of a vacuum-distributor and conduits provided on the drum, an assembling drum located adjacent the composition drum for receiving successive groups of two aligned cigarettes having a double-length filter therebetween from the composition drum, means for transferring a fastening band to the double-length filters while on the assembling drum for adherence to the double-length filter and the adjacent ends of the two aligned cigarettes, a rotating band carrying drum for feeding the fastening bands to the successive groups on the assembly drum including means for holding successive fastening bands by suction on the band carrying drum, wherein, in order to prevent a fastening band from being applied at a location devoid of a group comprising two cigarettes and one interposed double-length filter, each fastening band on the band carrying drum is provided with an adhesive on the outer face thereof, wherein the band carrying drum positions the fastening band relative to the assembling drum such that the front end of the fastening band, taken in the direction of rotation of the band carrying drum engages and is thus adhered to and picked up by the associated group of two cigarettes with a double-length filter therebetween while the latter is on the assembling drum, and means are provided at the zone where the band is picked up by the associated group to effect a partial reduction of the suction holding said band to said band carrying drum, such that the residual suction force will then be smaller than the adhesion force between the band and associated group of cigarettes and double-length filter, permitting the band to be detached from the band carrying, drum and picked up by engagement and adhesion to the said group when the latter is present on the assembling drum, and wherein upon the absence of such a group on the assembling drum, the associated band is held by said residual suction on the band carrying drum and moves past the pickup zone for subsequent removal.

6. A machine according to claim 5, wherein the front end of each band is held on the band carrying drum by means of a plurality of suction holes communicating with two successive manifold ducts which open into a head surface of the band carrying drum at two positions which are at different distances from the axis of the band carrying drum and in registry with an arcuate suction groove which is coaxial with the band carrying drum and is provided in a stationary distributor body which is sealingly engaged by said head surface of said band carrying drum, said arcuate suction groove being connected to the vacuum source and being radially narrowed at the zone where the band is picked up by the associated groove, such that only a portion of the suction holes are left in communication with the narrowed extension of the suction grooves while the remaining portion of the suction holes communicate with atmosphere by means of a corresponding vacuum-breaking recess provided in the distributor body.

7. A machine according to claim 6, wherein, in addition to the suction holes associated with the front end of the band, each band is held on the band carrying drum by means of successive suction holes connected to manifold ducts which open into the head surface of the band carrying drum at such a radial distance form its axis of rotation as to communicate with the vacuum breaking recess provided at the zone where the band is picked up.

8. A machine according to claim 6, wherein the front end of each band is held on the band carrying drum by a plurality of suction holes and downstream of the zone where the band is picked up, taken in the direction of rotation of the band drum, the distributor body comprises a vacuum breaking recess connected to the atmosphere and with which communication is established by the portion of the suction holes left in communication with the narrowed extension of the suction groove at the zone where the band is picked up.

* * * * *